US008632069B2

(12) United States Patent
Iino

(10) Patent No.: US 8,632,069 B2
(45) Date of Patent: Jan. 21, 2014

(54) IMAGE FORMING DEVICE WITH RECARRYING PATH

(75) Inventor: Hikaru Iino, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/428,020

(22) Filed: Mar. 23, 2012

(65) Prior Publication Data

US 2013/0043638 A1 Feb. 21, 2013

(30) Foreign Application Priority Data

Aug. 18, 2011 (JP) ..... 2011-178822

(51) Int. Cl.
*G03G 15/01* (2006.01)

(52) U.S. Cl.
USPC ..... 271/225; 399/401

(58) Field of Classification Search
USPC ..... 271/225, 270, 272, 242; 399/401
See application file for complete search history.

(56) References Cited

U.S. PATENT DOCUMENTS 5,176,373 A * 1/1993 Namba ..... 271/3.01
5,974,298 A * 10/1999 Urban et al. ..... 399/401
7,866,653 B2 * 1/2011 Tu ..... 271/3.01
2004/0022565 A1 * 2/2004 Tomono et al. ..... 399/401
2011/0102983 A1 5/2011 Souda et al.

FOREIGN PATENT DOCUMENTS

JP 07-261471 10/1995
JP 2004-029289 1/2004
JP 2008-189448 8/2008
JP 2011-095495 5/2011

* cited by examiner

*Primary Examiner* — Jeremy R Severson
(74) *Attorney, Agent, or Firm* — Banner & Witcoff, Ltd.

(57) ABSTRACT

An image forming device, comprising: a main body; an image formation unit; and a re-carrying path along which a sheet-like medium on which the image has been formed is carried again to the image formation unit. In this configuration, the re-carrying path comprises: a first path formed to extend downward; a bending part formed to bend from a lower end of the first path toward an upstream side of the image formation unit; and a second path formed to extend from the bending part toward the upstream side of the image formation unit. A pair of re-carrying rollers which carry the sheet-like medium are provided on the second path. A recessed part formed to be recessed downward with respect to a common tangential line of the pair of re-carrying rollers is provided on the second path between the bending part and the pair of re-carrying rollers.

4 Claims, 5 Drawing Sheets

IMAGE FORMING DEVICE WITH RECARRYING PATH

CROSS-REFERENCE TO RELATED APPLICATION

This application claims priority under 35 U.S.C. §119 from Japanese Patent Application No. 2011-178822, filed on Aug. 18, 2011. The entire subject matter of the application is incorporated herein by reference.

BACKGROUND

1. Technical Field

Aspects of the present invention relate to an image forming device capable of printing on both sides of a sheet-like medium.

2. Related Art

An image forming device which includes an image formation unit forming an image on a sheet-like medium and a re-carrying path for carrying the sheet-like medium again to the image formation unit to form an image on a back side of the sheet-like medium for which the image has been formed on a front side of the sheet-like medium by the image formation unit is known. Specifically, the re-carrying path in the image forming device includes a first path extending downward from a downstream side of the image formation unit in a carrying direction, a bended part formed to bend from a lower end of the first path toward an upstream side of the image formation unit in the carrying direction, and a second path extending toward the upstream side of the image formation unit in the carrying direction. In the second path, a plurality of pairs of re-carrying rollers for carrying the sheet-like medium are provided.

SUMMARY

However, regarding the re-carrying path of the conventional image forming device, there is a possibility that when the sheet-like medium which has passed the first path and has been bent in the bended part contacts a re-carrying roller, the sheet-like medium bows downward and is pressed by a strong force against a lower wall, and as a result the sheet-like medium is folded and thereby is jammed near the re-carrying roller.

Aspects of the present invention are advantageous in that an image forming device capable of preventing a sheet-like medium from being jammed near a re-carrying roller is provided.

According to an aspect of the invention, there is provided an image forming device, comprising: a main body; an image formation unit that formed an image on a sheet-like medium; and a re-carrying path along which the sheet-like medium on which the image has been formed by the image formation unit is carried again to the image formation unit. In this configuration, the re-carrying path comprises: a first path formed to extend downward from a downstream side in a carrying direction of the image formation unit; a bending part formed to bend from a lower end of the first path toward an upstream side in the carrying direction of the image formation unit; and a second path formed to extend from the bending part toward the upstream side in the carrying direction of the image formation unit. The second path is provided with a pair of re-carrying rollers which carry the sheet-like medium. A recessed part formed to be recessed downward with respect to a common tangential line of the pair of re-carrying rollers is provided on the second path between the bending part and the pair of re-carrying rollers.

With this configuration, it becomes possible to absorb bowing of the sheet-like member contacting the re-carrying roller at the recessed part, and therefore it becomes possible to prevent the sheet-like member from being jammed near the re-carrying roller.

According to another aspect of the invention, there is provided an image forming device, comprising: a main body; an image formation unit that formed an image on a sheet-like medium; and a re-carrying path along which the sheet-like medium on which the image has been formed by the image formation unit is carried again to the image formation unit. In this configuration, the re-carrying path comprises: a first path formed to extend downward from a downstream side in a carrying direction of the image formation unit; a bending part formed to bend from a lower end of the first path toward an upstream side in the carrying direction of the image formation unit; and a second path formed to extend from the bending part toward the upstream side in the carrying direction of the image formation unit. A pair of re-carrying rollers which carry the sheet-like medium are provided on the second path. A carrying surface of an upstream side end part of the second path is formed to bend toward an outside of the bending part with respect to a common tangential line of the pair of re-carrying rollers.

With this configuration, it becomes possible to absorb bowing of the sheet-like member contacting the re-carrying roller at the bended carrying surface, and therefore it becomes possible to prevent the sheet-like member from being jammed near the re-carrying roller.

BRIEF DESCRIPTION OF THE ACCOMPANYING DRAWINGS

DETAILED DESCRIPTION

Hereafter, an embodiment according to the invention will be described with reference to the accompanying drawings. In the following, first a general configuration of a color printer 1 which is an example of an image forming device according to the embodiment is explained, and then the feature of the embodiment is explained.

Figure 1:
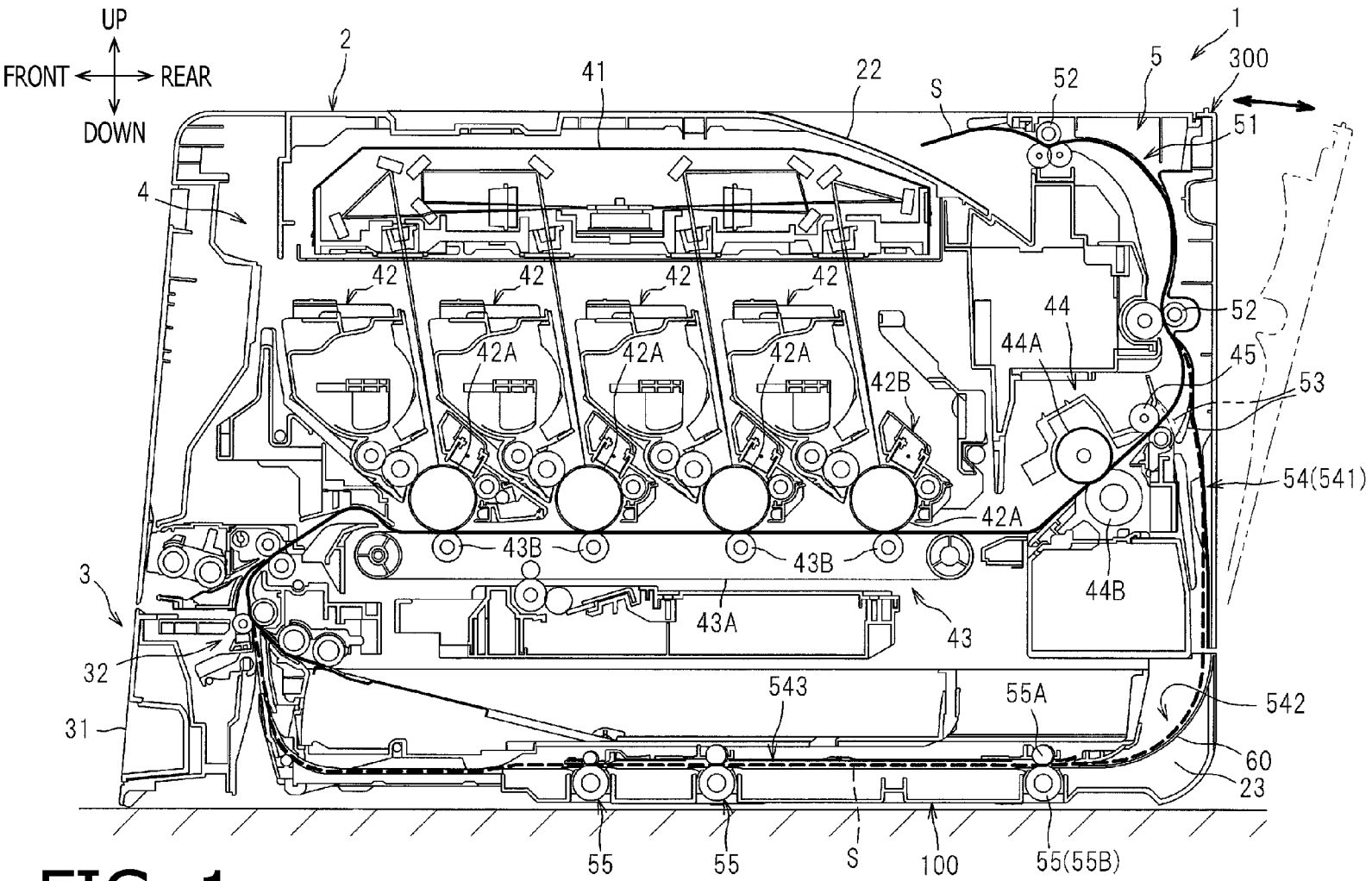
FIG. 1 is a cross sectional view illustrating a color printer according to an embodiment.

In the following, directions are defined with reference to a user who is using the color printer 1. That is, in FIG. 1, a left side on a paper face of FIG. 1 is defined as a "front side", a right side on the paper face of FIG. 1 is defined as a "rear side", a far side in FIG. 1 is defined as a "left side", and a near side in FIG. 1 is defined as "right side". The up and down direction on the paper face of FIG. 1 is defined as a "vertical direction".

(Overall Configuration of Color Printer)

As shown in FIG. 1, the color printer 1 is able to form images on both sides of paper S which is an example of a sheet-like medium. The color printer 1 includes, as main components, a paper supply unit 3, an image formation unit 4 and a carrying unit 5 in a main body 2.

The paper supply unit 3 is provided under the main body 2, and includes a paper supply tray 31 which accommodates the paper S and a paper supply mechanism 32. The paper S accommodated in the paper supply tray 31 is carried to make a U-turn from the front side toward the rear side in the main body 2, and is supplied to the image formation unit 4. The paper supply tray 31 can be removed from the main body 2 by drawing toward the front side, and can be attached to the main body by pressing toward the rear side. The paper supply tray 31 is provided to extend in the front and rear direction at a bottom of the main body 2.

The image formation unit 4 is arranged above the paper supply tray 31, and is configure to form an image on the paper S being carried from the paper supply unit 3. The image formation unit 4 includes an exposure unit 41, four process units 42, a transfer unit 43 and a fixing unit 44.

The exposure unit 41 is provided at an upper portion of the main body, and includes a laser source (not shown), a polygonal mirror, a plurality of lenses and a plurality of mirrors (no reference numbers are assigned thereto). A laser beam emitted from the laser source based on image data is reflected from the polygonal mirror and the mirrors, passes through the lens, and then scans on a surface of each photosensitive drum 42A at a high speed.

The process units 42 are arranged in parallel in the front and rear direction between the paper supply tray 31 and the exposure unit 41. The process unit 42 includes the photosensitive drum 42A, a charger 42B, a development roller, a supply roller, a layer thickness limit blade, and a toner reservoir for storing toner (a developer) (no reference numbers are assigned to these components). The process units 42 have substantially the same configuration, excepting that colors of the toner stored in the toner reservoirs are different from each other.

The transfer unit 43 is provided between the paper supply tray 31 and the process units 42, and includes an endless carrying belt 43A stretched between a drive roller and a driven roller (to which no reference numbers are assigned), and four transfer rollers 43B. The carrying belt 43A is provided such that the outer surface thereof contacts the photosensitive drums 42A. Inside the carrying belt 43A, the transfer rollers 43B are arranged such that the carrying belt 43A is sandwiched between the photosensitive drums 42A and the transfer rollers 43B.

The fixing unit 44 is provided on the rear side of the process units 42, and includes a heat roller 44A and a press roller 44B which is arranged to face the heat roller 44A to press the heat roller 44A.

In the image formation unit 4, a surface of the photosensitive drum 42A is charged uniformly by the charger 42B and then is exposed to the laser light from the exposure unit 41, and as a result an electrostatic latent image based on the image data is formed on the photosensitive drum 42A. The toner in the toner reservoir is supplied to the development roller via the supply roller, proceeds to the space between the development roller and the layer thickness limit blade, and is held on the development roller as a thin layer having a constant thickness.

The toner held on the development roller is supplied to the photosensitive drum 42A on which the electrostatic latent image is formed, so that the electrostatic latent image is visualized and a toner image is formed on the photosensitive drum 42A. Thereafter, the paper S supplied from the paper supply unit 3 is carried between the photosensitive drum 42A and the carrying belt 43A (the transfer roller 43B) so that the toner image formed on each of the photosensitive drums 42A is transferred to the paper S such that the toner images are sequentially superimposed on the paper S.

The paper S on which the toner image has been transferred is carried between the heat roller 44A and the press roller 44B so that the toner image is heat-fixed on the paper S. Thus, an image is formed on the paper S. The paper S on which the image has been formed is carried by a carrying roller 45 toward a carry path 51 from the fixing unit 44 (the image formation unit 4).

The carrying unit 5 functions as an ejecting unit which ejects the paper S carried out from the image formation unit 4 to the outside of the main body 2, and as a re-carrying unit which carries again the paper S to the image formation unit 4 in a state where the paper P is reversed. Specifically, the carrying unit 5 includes a carrying path 51, a carrying roller 52, a flapper 53 arranged to be able to swing in the front and rear direction, a re-carrying path 54, and a plurality of pairs of re-carrying rollers 55 which carry the paper S in the re-carrying unit 54.

The carrying path 51 is provided in a rear portion in the main body 2, and is configured to extend upward from the front side of the flapper 53 which has swung to the rear side (see a solid line) and then to bend toward the front side.

The carrying roller 52 is configured to be able to rotate both in forward and backward directions. When the carrying roller 52 rotates in the forward direction, the paper S carried from the image formation unit 4 is ejected to the outside of the main body 2. When the carrying roller 52 rotates in the backward direction, the paper S is carried to be drawn into the inside of the main body 2.

The re-carrying path 54 is formed to carry again the paper S, whose one face has been subjected to the image formation by the image formation unit 4, to the image formation unit 4. The re-carrying path 54 is provided to extend from the rear portion to the bottom of the main body 2. Specifically, the re-carrying path 54 includes a first path 541, a bending part 542 and a second path 543.

The first path 541 is formed to extend downward from the rear portion of the flapper 53 (from the downstream side of the image formation unit 4) which has swung to the front side (see a chain line).

The bending part 542 connects the first path 541 extending in the vertical direction with the second path 543 extending in the horizontal direction. The bending part 542 is formed to bend from the lower end of the first path 541 toward the front side. The term "horizontal direction" as used herein includes a direction which is slightly inclined with respect to the horizontal direction.

The second path 543 is formed to extend to the front side in the horizontal direction from the bending part 542, and then to extend toward the paper supply mechanism 32 provided on the upper side (i.e., the upstream side of the image formation unit 4).

In the carrying unit 5, when the image formation finishes, the paper P carried from the image formation unit 4 is carried through the carrying path 51, is ejected to the outside of the main body 2 by the carrying roller 52 rotating in the forward direction, and then is placed on the ejection tray 22. When image formation is to be performed on the other face of the paper P whoso one face has been subjected to the image formation, the carrying roller 52 rotates in the backward direction before the entire paper S is ejected to the outside of the main body 2, so that the paper S is drawn again into the main body 2 and is carried from the carrying path 51 to the re-carrying path 54. Thereafter, the paper S (see a dashed line) is carried through the re-carrying path 54 by the re-carrying rollers 55, and is carried again to the image formation unit 4 by the paper supply mechanism 32.

It should be noted that the paper S whose other face has been subjected to the image formation in the image formation unit 4 is carried from the image formation unit 4 to the carrying path 51, is ejected to the outside of the main body 2 by the carrying roller 52 rotating in the forward direction, and the is placed on the ejection tray 22.

(Details of Configuration of Bending Part 542 and Second Path 543)

The bending part 542 is formed of a steel plate 60 which is an example of a bending part forming member. A part (a rear part) of the second path 543 is formed of a re-carrying unit 100 which is an example a second path forming member.

The steel plate 60 is formed to bend in a shape of an arc (i.e., a shape formed to extend along the bending part 542) when viewed as a cross section. That is, the steel plate 60 is arranged to extent along the bending part 542. Furthermore, the steel plate 60 is formed to extend in the left and right direction so as to be connected with a pair of left and right side frames 23. More specifically, the steel plate 60 is formed to have a shape of an arc protruding toward the outside of the main body 2.

As described above, by connecting the pair of side frames 23 with each other by using the steel plate 60 formed to extend along the bending part 542, it becomes possible to reinforce the pair of side frames 23 without increasing the size of the main body 2, in comparison with a structure in which a pair of side frames are connected by a reinforcing tubular pipe in the vicinity of the bending part. Since the steel plate 60 forming the bending part 542 serves also as a reinforcing member for the pair of side frames 23, it becomes possible to simplify the structure in comparison with a structure in which another member forming the bending part is provided in addition to the steel plate.

The re-carrying unit 100 contains resin, and is provided close to the front of the steel plate 60 (i.e., the downstream side of the steel plate 60 in the carrying direction) under the paper supply tray 31. That is, the re-carrying unit 100 is a separate member separately provided with respect to the steel plate 60 and contains resin. In this case, since the re-carrying rollers 55 can be easily arranged in comparison with a structure in which the second path is formed by extending the steel plate forming the bending part toward the front side, it becomes possible to simplify the structure.

Figure 2:
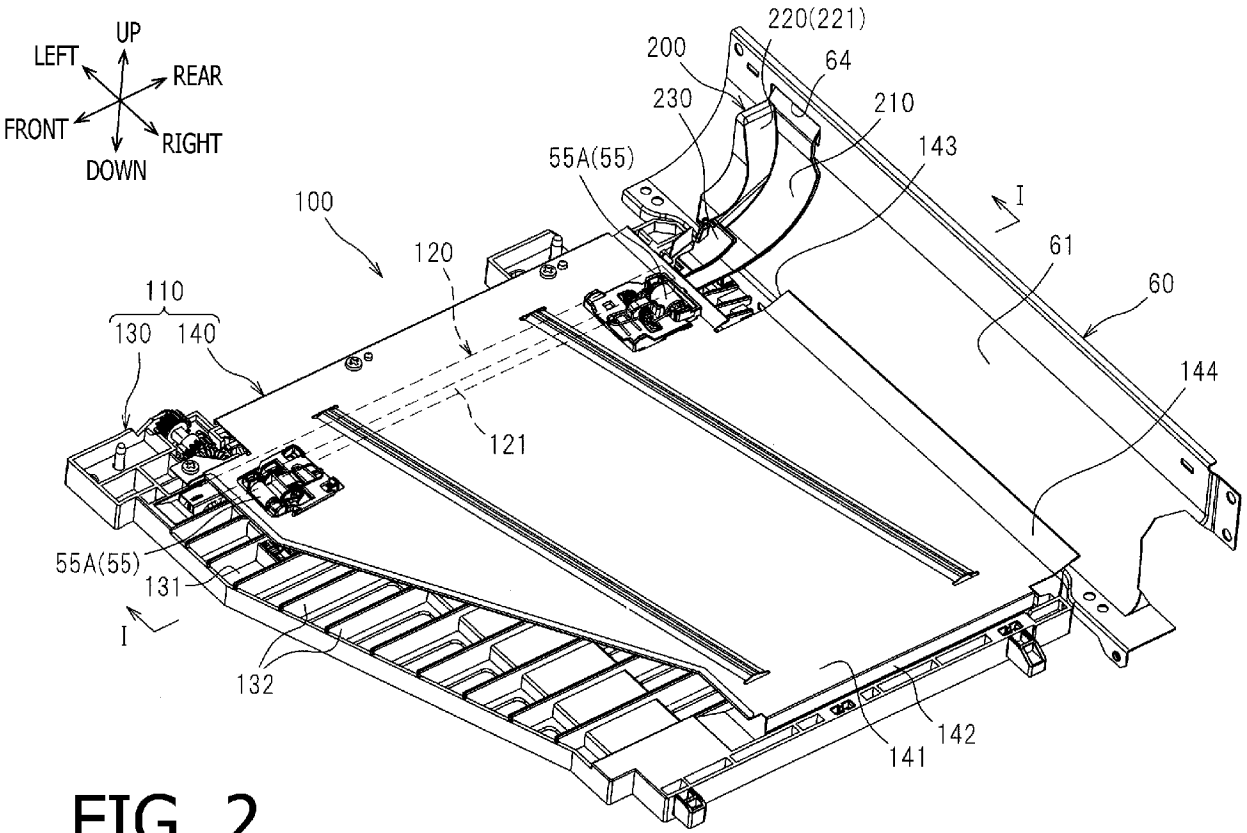
FIG. 2 is a perspective view of a re-carrying unit, a steel plate and a guide member.

The re-carrying unit 100 is fixed to the main body 2, and the paper supply tray 31 can be detachably attachable, in the front and rear direction, to the re-carrying unit 100 fixed as described above and the main body 2. As shown in FIG. 2, the re-carrying unit 100 is formed in a shape of a flat plate, and includes a guide body 110, an edge restriction member 120 and two pairs of re-carrying rollers 55.

The guide body 110 includes a lower carrying member 130 and an upper carrying member 140 arranged to have an interval in the vertical direction, and the second path 543 is formed between the lower carrying member 130 and the upper carrying member 140.

The lower carrying member 130 is made of resin, and is formed to have the width larger than the width (the length in the left and right direction) of the paper S. The lower carrying member 130 includes a plate-like bottom wall 131 and first ribs 132.

Figure 3:
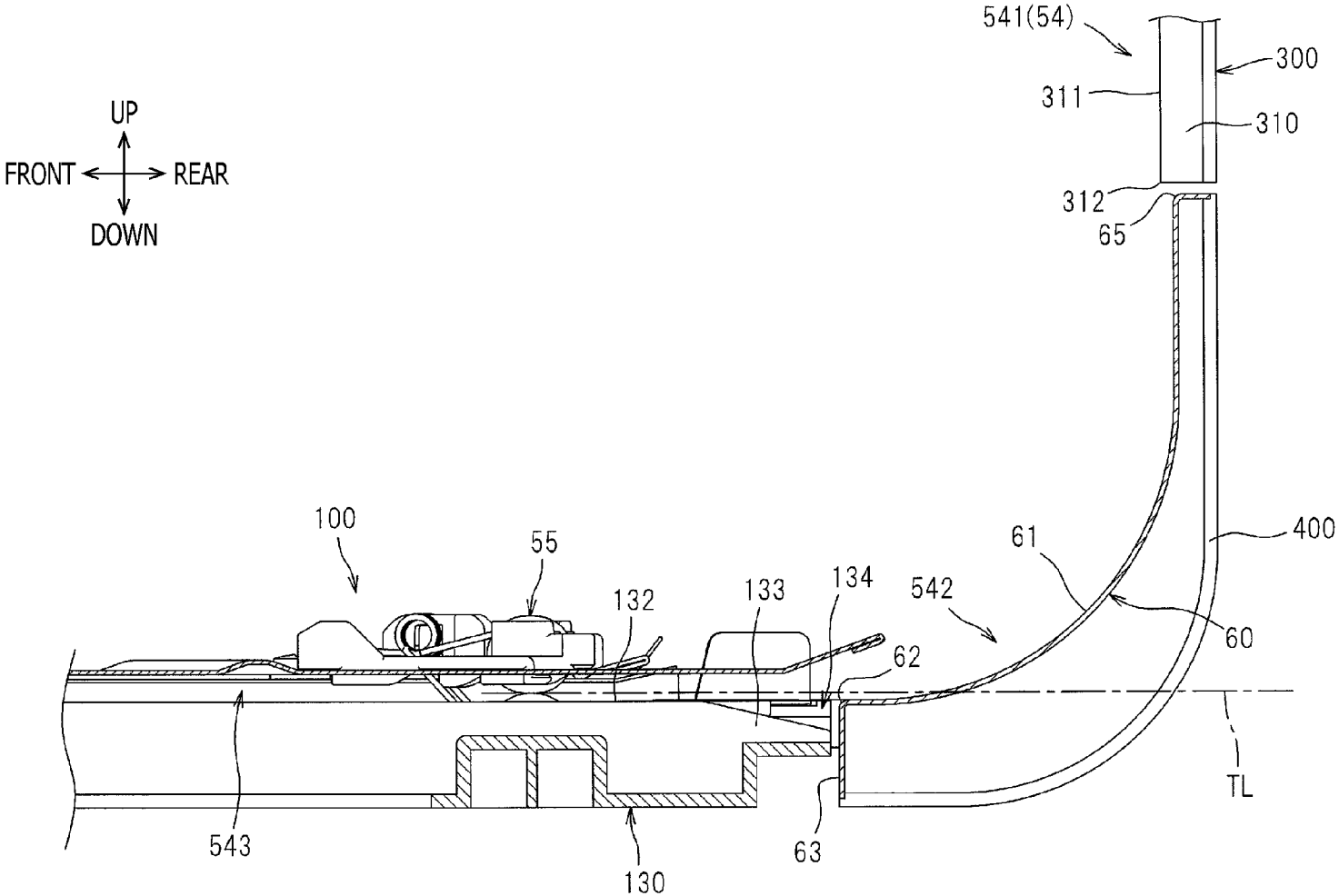
FIG. 3 is a cross section viewed along a line I-I in FIG. 2.

Each first rib 132 supports and guides the lower face of the paper S. Specifically, each first rib 132 is formed to protrude upward from the bottom wall 131 and to extend in the carrying direction of the paper S. The plurality of first ribs 132 are provided to have certain intervals in the width direction of the paper S. As shown in FIG. 3, at the rear end of the first rib 132, a slanting part 133 is formed to be slanted upward from the position lower than the front edge 62 (a downstream end in the paper carrying direction) of a guide surface 61 which is a part of the steel plate 60 guiding the paper S.

In other words, the rear end of the lower carrying member 130 is located at the position lower than the front end of the steel plate 60. With this configuration, it becomes possible to prevent the leading edge of the paper S from hitting against the lower carrying member 130 when the paper S passes through a joint between the steel plate 60 and the lower carrying member 130.

On the front side of the steel plate 60, a flange part 63 is formed to extend downward from the front edge 62 of the guide surface 61. By a front surface of the flange part 63 (a front end surface of the steel plate 60) and the slanting part 133, a recessed part 134 which is recessed downward from a common tangential line TL of the pair of re-carrying rollers 55 is formed.

That is, since the recessed part 134 which is recessed downward with respect to the common tangential line TL of the pair of re-carrying rollers 55 is provided between the re-carrying roller 55 and the bending part 542, sagging in the downward direction of the paper S caused when the paper S contacts the re-carrying roller 55 can be absorbed by the recessed part 134. As a result, it becomes possible to prevent the paper S from being jammed in the vicinity of the re-carrying roller 55.

As shown in FIG. 2, the upper carrying member 140 is made of a steel plate, and includes an upper wall 141 formed to be larger than the width of the paper S (i.e., the length in the left and right direction) and both end parts 142 formed to be folded downward from the both end parts of the upper wall 141. The upper carrying member 140 is fixed to the lower carrying member 130 at the both end parts thereof, and therefore the upper wall 141 can be located to be spaced from the. Between the upper wall 141 and the lower carrying member 130, the edge restriction member 120 is provided.

The edge restriction member 120 is formed to have a restriction surface 121 which contacts the left edge of the paper S and restricts the position of the left edge of the paper S. The edge restriction member 120 is formed to be long in the front and rear direction, and is provided on the left side (on one side in the width direction) of the lower carrying member 130. On the left side of the upper carrying member 140, two oblique rollers 55A which carry the paper S while bringing the paper S near to the edge restriction member 120 are provided to have a certain interval in the front and rear direction therebetween.

The oblique roller 55A forms one of the pair of re-carrying rollers 55, and the other of the pair of re-carrying rollers 55 is formed of a drive roller 55B (see FIG. 1). The oblique roller 55A is arranged to be slanted with respect to the drive roller 55B.

With this configuration, when the drive roller 55B rotates, the paper S is carried to the left side by the oblique roller 55A being rotated in accordance with the drive roller 55B, and is bought near to the edge restriction member 120.

On the rear side of the edge restriction member 120, a guide member 200 for guiding the paper S toward the inside of the edge restriction member 120 in the left and right direction is provided. Specifically, on the left and rear side of the upper carrying member 140, a cut part 143 is formed to be recessed toward the front side, and the front part of the guide member 200 is arranged to be inserted into the cut part 143 so that the guide member 200 is provided to extend over the steel plate 60 and the lower carrying member 130.

The guide member 200 includes a lower wall 210 which supports the paper S from the lower side, a side wall 220 which protrudes inward from the left edge of the lower wall 210, and an upper wall 230 which protrudes inward in the left and right direction from the front part of the side wall 220 so as to face the lower wall 210 in the vertical direction.

Figure 4:
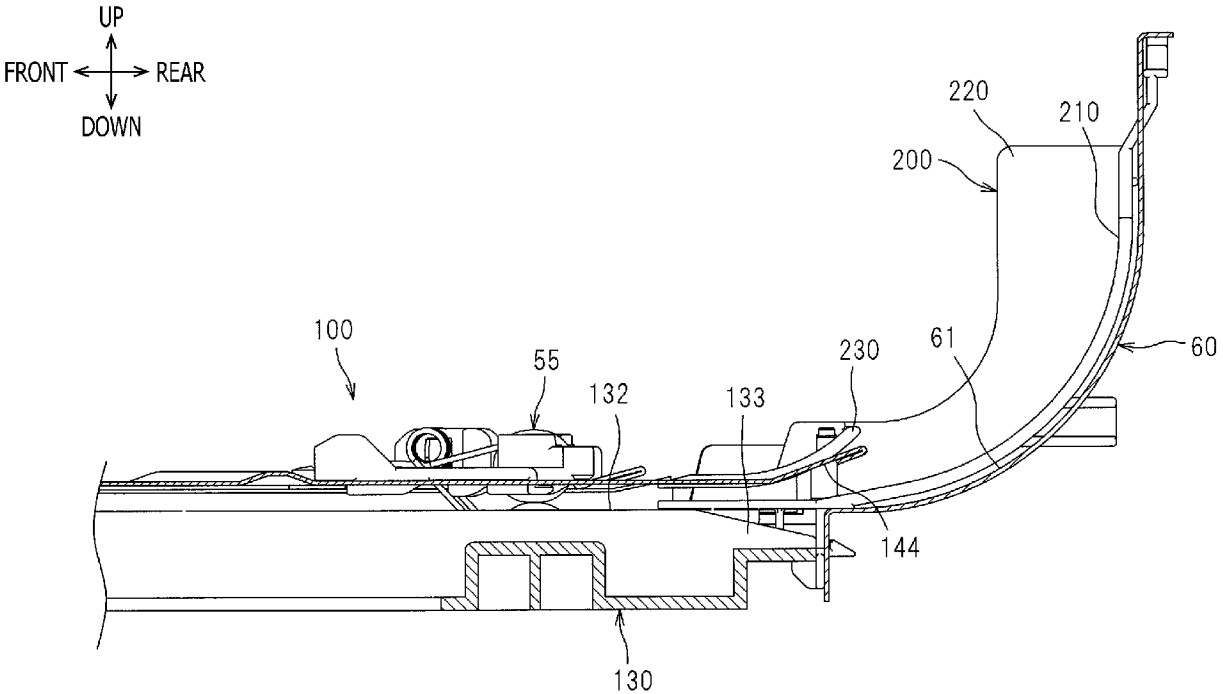
FIG. 4 is a cross section viewed along a line I-I in FIG. 2, and illustrates the guide member while omitting a cover part and a rear cover.

The lower wall 210 is formed to have a shape of an arc extending along the guide surface 61 of the bended steel plate 60 when viewed as a cross section. The upper part of the lower wall 210 is formed to pass through an engagement hole 64 formed in the left part of the steel plate 60 and to be held on the steel plate 60 by being hooked to the outer surface of the steel plate 60 as shown in FIG. 4. Furthermore, the lower end part of the lower wall 210 is formed to extend from the steel plate 60 side toward the lower carrying member 130 side, and is arranged above the upper surface (a supporting surface which supports the paper S) of the first rib 132.

With this configuration, when the paper S is carried from the steel plate 60 to the lower carrying member 130, it becomes possible to prevent the paper S from hitting against the joint between the steel plate 60 and the lower carrying member 130.

As shown in FIG. 2, the side wall 220 has a first guide surface 221 formed to extend, toward the restriction surface 121, from the position outside the restriction surface 121 of the edge restriction member 120 in the left and right direction. With this configuration, it becomes possible to prevent the paper S from hitting against the rear end of the edge restriction member 120 because, when the paper S is carried to the edge restriction member 120 in a state where the left edge of the paper S is shifted leftward with respect to the restriction surface 121 of the edge restriction member 120, the left edge of the paper S is guided to the restriction surface 121 of the edge restriction member 120 by the first guide surface 221 of the guide member 200.

As shown in FIG. 4, the upper wall 230 is formed over the rear end part of the lower carrying member 130 and the front end part of the steel plate 60. That is, the upper wall 230 is formed from the position where, when viewed in the vertical direction, the upper wall 230 overlaps with the lower carrying member 130, to the position where the upper wall 230 overlaps with the steel plate 60. Further, the upper wall 230 is formed to extend upward in a slanting direction toward the upstream side in the carrying direction. Furthermore, a rightward part 144 of the rear part of the upper carrying member 140 is also formed from the position where, when viewed in the vertical direction, the rightward part 144 overlaps with the lower carrying member 130 to the position where the rightward part 144 overlaps with the steel plate 60.

The rightward part 144 and the upper wall 230 are formed to overlap with each other when viewed in the left and right direction. With this configuration, it becomes possible to set an angle of inrush of the paper S to the re-carrying unit 100 by the upper wall 230 of the guide member 200 on the left side and the rightward part 144 of the upper carrying member 140, to be small, and thereby it becomes possible to smoothly carry the paper S from the steel plate 60 to the re-carrying unit 100.

For example, if the rightward part 144 and the upper wall 230 do not exist, the paper S departs from the guide surface 61 of the bended steel plate 60 and stands substantially in the vertical direction due to the elasticity of the paper S when the leading edge of the paper S which has been carried along the steel plate 60 reaches the lower carrying member 130. As a result, the angle of inrush of the paper S with respect to the second path 534 arranged in the horizontal direction becomes large, and thereby it becomes difficult to smoothly carry the paper S to the second path 534. By contrast, according to the embodiment, it is possible to prevent the paper S from departing from the guide surface 61 due to elasticity of the paper S, by the above described upper wall 230 and the rightward part 144. Therefore, it becomes possible to set the angle of inrush of the paper S to the re-carrying unit 100 to be small, and thereby it becomes possible to smoothly carry the paper S from the steel plate 60 to the re-carrying unit 100.

As shown in FIG. 2, the re-carrying rollers 55 are configured to be capable of carrying the paper S in the slanting direction with respect to the carrying direction of the paper S so as to cause the leftward edge of the paper S to contact the edge restriction member 120, and are arranged on the edge restriction member 120 side in the left and right direction. One of the two pairs of re-carrying rollers 55 is provided closely to the rear end of the cut part 143 and the other of the two pairs of re-carrying rollers 55 is provided closely to the front end of the upper carrying member 140.

As shown in FIG. 1, the re-carrying roller 55 located on the most upstream side on the second path 543 is configured such that the carrying speed is slower than that of the carrying roller 52 located on the upstream side of the re-carrying roller 55. As a result, occurrence of a problem that would arise when the carrying speed of the re-carrying roller 55 is faster than that of the carrying roller 52 (i.e., a problem that the paper S becomes a strained state between the re-carrying roller 55 and the carrying roller 52, and thereby the paper S is damaged, or the paper S slips and thereby the re-carrying roller 55 is damaged) can be prevented. When the carrying speed of the re-carrying roller 55 is slower than that of the upstream side carrying roller 52 as described above, the paper S tends to bow when contacting the re-carrying roller 55. However, the bowing of the paper S can be absorbed by the above described recessed part 134 (see FIG. 3).

Figure 5:
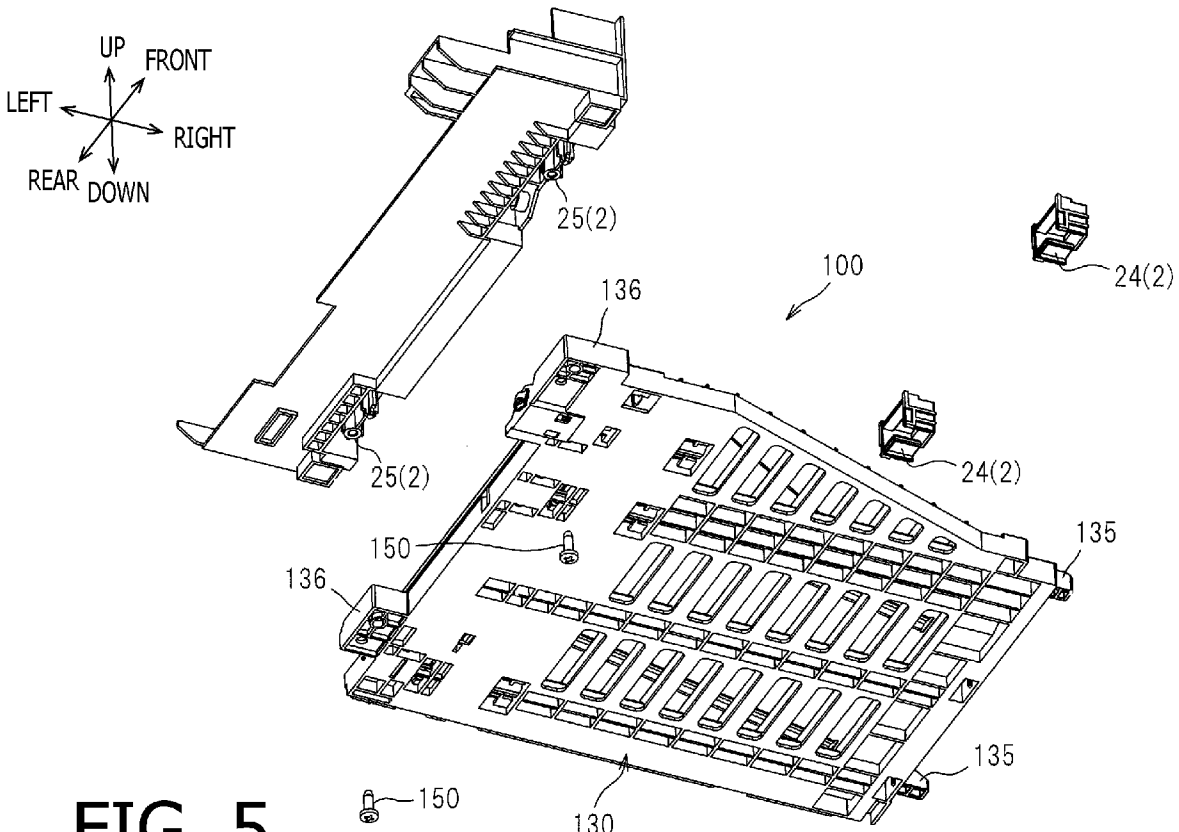
FIG. 5 is an exploded perspective view illustrating an attachment structure of a main body and the re-carrying unit.

As shown in FIG. 5, the re-carrying unit 100 is configured such that the right edge thereof (the edge opposite to the edge restriction member 120 in the width direction) engages with the main body 2, and the left edge thereof (the edge on the edge restriction member 120 side) is fixed to the main body 2 by screws 150 (fixing members). Specifically, on the front part and the rear part of the right side face of the lower carrying unit 130 of the re-carrying unit 100, engagement projections 135 protruding outward in the left and right direction are respectively provided. On the front part and the rear part of the left side face of the lower carrying member 130, fixing projections 136 protruding outward in the left and right direction are respectively provided.

The two engagement projections 135 are placed on two engagement pieces 24 formed on the main body 2, and the two fixing projections 136 are fixed, by the screws 150, to two screw holes 25 formed in the main body 2. With this configuration, it becomes possible to precisely position the leftward edge restriction member 120 with respect to the main body 2 by fixing, and to ease the installation work for fixing the re-carrying unit 100 to the main body 2 by not fixing the right side of the re-carrying unit 100.

As shown in FIG. 3, a rear cover 300 is provided on the upstream side of the steel plate 60 in the carrying direction. On an inner surface of the rear cover 300, a plurality of second ribs 310 each of which is formed to protrude inward and extend in the carrying direction are provided to have intervals in the left and right direction.

The inner surface of the second rib 310 is formed as a second guide surface 311 for carrying the paper S toward the steel plate 60. An upstream side edge 65 of the steel plate 60 in the carrying direction is provided at a position (a position departing from the paper S) on the rear side with respect to the downstream side edge 312 of the second guide surface 311 in the carrying direction. As a result, it becomes possible to prevent the leading edge of the paper S from hitting against the steel plate 60 when the paper S is carried from the second rib 310 to the steel pate 60.

Furthermore, as shown in FIG. 1, the rear cover 300 is rotatably supported by the main body 2. As a result, it becomes possible to pull out the paper S jammed in the first path 541 by rotating the rear cover 300 to open the first path 541 when the paper S is jammed on the first path 541.

As shown in FIG. 3, on the outside of the steel plate 60, a covering member 400 which extends to cover the steel plate 60 over the downstream side end of the rear cover 300 in the carrying direction and the upstream side end of the re-carrying unit 100 in the carrying direction is provided. With this configuration, since a user does not directly contact the steel plate 60, it becomes possible to prevent the steel plate 60 forming the bending part 542 of the re-carrying path 54 from deforming.

Although the present invention has been described in considerable detail with reference to certain preferred embodiments thereof, other embodiments are possible.

In the above described embodiment, a thick paper, a post card and a thin paper are exemplified as the sheet-like medium (paper S). The present invention is not limited to such examples. For example, the sheet-like medium may be an OHP sheet.

In the above described embodiment, the image formation unit 4 is formed of the components including the exposure unit 41. However, the present invention is not limited to such an example. For example, an LED head may be used in place of the exposure init 41, a belt-like photosensitive body may be used in place of the photosensitive drum 42A, a cylindrical fixing film slidably supported by a guide may be used in place of the heat roller 44A. Furthermore, in place of the transfer roller 43B, another type of member to which a transfer bias is applied, such as a conductive brush or a conductive leaf spring, may be used.

In the above described embodiment, the present invention is applied to the color printer 1. However, the present invention is not limited to such an example. For example, the present invention may be applied to another type of image forming device, such as a copying machine or a multifunction peripheral.

In the above described embodiment, the screw 150 is used as a fixing member. However, the present invention is not limited to such an example. For example, a bolt and a nut may be used as the fixing member.

What is claimed is:

1. An image forming device, comprising:

a main body;

an image formation unit that formed an image on a sheet-like medium; and a re-carrying path along which the sheet-like medium on which the image has been formed by the image formation unit is carried again to the image formation unit, wherein the re-carrying path comprises:

a first path formed to extend downward from a downstream side in a carrying direction of the image formation unit;

a bending part formed to bend from a lower end of the first path toward an upstream side in the carrying direction of the image formation unit; and a second path formed to extend from the bending part toward the upstream side in the carrying direction of the image formation unit, wherein a pair of re-carrying rollers which carry the sheet-like medium are provided on the second path, wherein a recessed part formed to be recessed downward with respect to a common tangential line of the pair of re-carrying rollers is provided on the second path between the bending part and the pair of re-carrying rollers, wherein the bending part bends outwardly with respect to a first surface of the sheet-like medium and wherein the recessed part is recessed downwardly with respect to the same surface of the sheet-like medium, and wherein the re-carrying path is configured such that the sheet-like medium is carried through the bending part and reaches the recessed part before the sheet-like medium reaches any rollers.

2. The image forming device according to claim 1, wherein the pair of re-carrying rollers are configured such that a carrying speed is slower than that of a carrying roller provided on an upstream side in the carrying direction of the pair of re-carrying rollers.

3. The image forming device according to claim 1, further comprising:

a second path forming member that forms the second path; and a bending part forming member that is provided separately from the second path forming member and forms the bending part, wherein:

a slanting part is formed on an upstream side in the carrying direction of the second path forming member such that the slanting part extends upward in a slanting direction toward a downstream side in the carrying direction from a position lower than a downstream side edge in the carrying direction of a guide surface formed on the bending part forming member to guide the sheet-like medium; and the recessed part is formed by the slanting part and a downstream side end face in the carrying direction of the bending part forming member.

4. An image forming device, comprising:

a main body;

an image formation unit that formed an image on a sheet-like medium; and a re-carrying path along which the sheet-like medium on which the image has been formed by the image formation unit is carried again to the image formation unit, wherein the re-carrying path comprises:

a first path formed to extend downward from a downstream side in a carrying direction of the image formation unit;

a bending part formed to bend from a lower end of the first path toward an upstream side in the carrying direction of the image formation unit; and a second path formed to extend from the bending part toward the upstream side in the carrying direction of the image formation unit, wherein the second path is provided with a pair of re-carrying rollers which carry the sheet-like medium, wherein a carrying surface of an upstream side end part of the second path is formed to bend toward an outside of the bending part with respect to a common tangential line of the pair of re-carrying rollers, wherein the bending part bends outwardly with respect to a first surface of the sheet-like medium and wherein the carrying surface of the upstream side end part of the second path is recessed downwardly with respect to the same surface of the sheet-like medium, and wherein the re-carrying path is configured such that the sheet-like medium is carried through the bending part and reaches the recessed part before the sheet-like medium reaches any rollers.

* * * * *